US006086022A

United States Patent [19]

Dalton

[11] Patent Number: 6,086,022

[45] Date of Patent: Jul. 11, 2000

[54] SHOULDER-MOUNTED TRASH BAG HOLDER

[76] Inventor: Earl F. Dalton, 1169 Charlotte Ave., Yuba City, Calif. 95991

[21] Appl. No.: 09/195,962

[22] Filed: Nov. 19, 1998

[51] Int. Cl.[7] ..... B65B 67/04

[52] U.S. Cl. ..... 248/99; 248/95; 248/101

[58] Field of Search ..... 248/99, 95, 101; 294/1.1; 383/33, 68, 43; 141/313, 314, 391, 315, 316, 317

[56] References Cited

U.S. PATENT DOCUMENTS

| | | | |
|---|---|---|---|
| 1,353,330 | 9/1920 | Erickson | 248/101 |
| 3,893,649 | 7/1975 | Cornell et al. | 248/99 |
| 3,997,072 | 12/1976 | Guth | 248/101 X |
| 5,217,271 | 6/1993 | Moe | 248/99 X |
| 5,275,490 | 1/1994 | Loebert | 248/99 X |
| 5,413,261 | 5/1995 | Wu | 294/31.2 X |
| 5,641,138 | 6/1997 | Cronk et al. | 248/99 |
| 5,957,585 | 9/1999 | Dabrowski | 248/99 X |

*Primary Examiner*—Leslie A. Braun
*Assistant Examiner*—A. Joseph Wujciak

[57] ABSTRACT

A trash bag support system is provided including an inner ring and an outer ring. The outer ring is adapted to snappily attach to the inner ring in order to maintain an upper peripheral edge of a garbage bag therebetween. As such, an opening of the garbage bag is maintained in an open orientation.

11 Claims, 3 Drawing Sheets

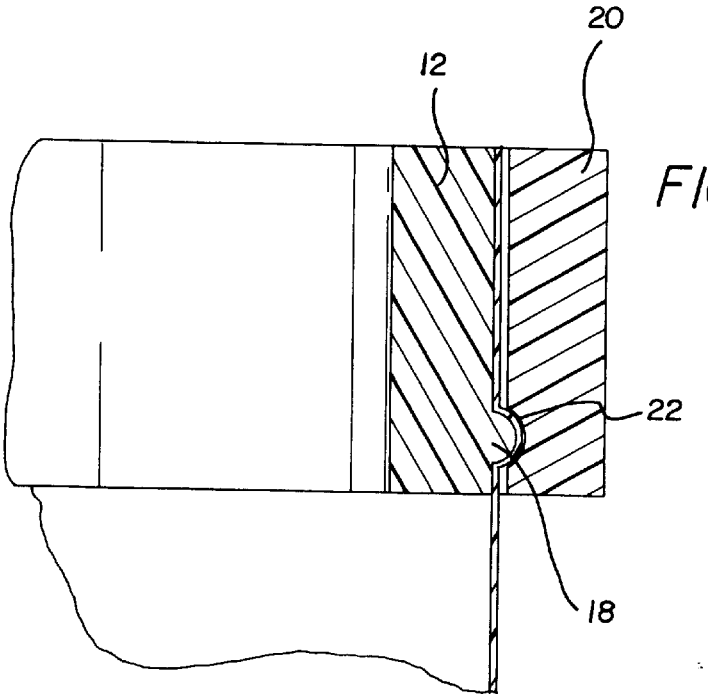
FIG.3
FIG.4
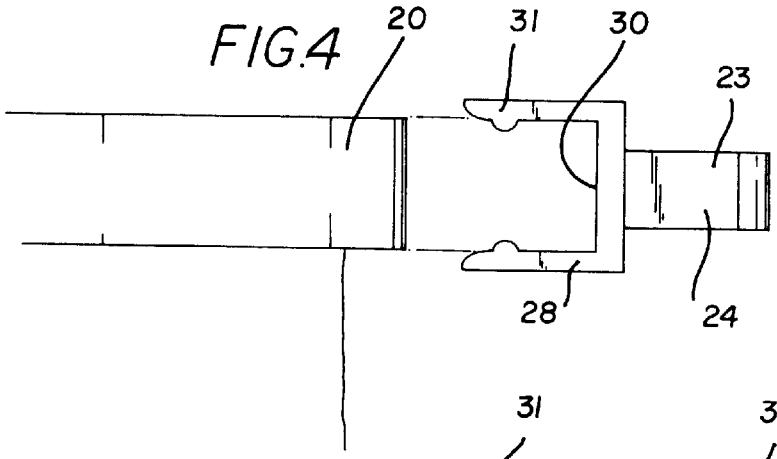
FIG.5
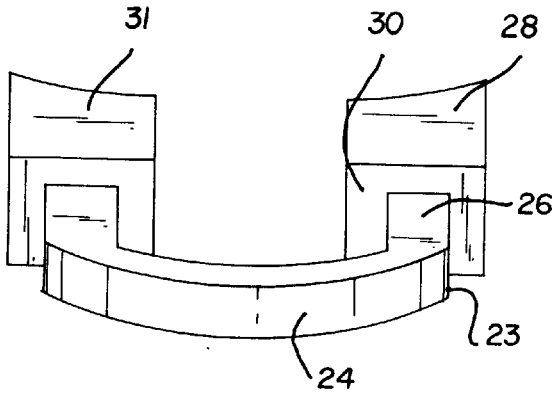

42

32
12
23
14
16
40
20

32
42

40
34
33
36
38

SHOULDER-MOUNTED TRASH BAG HOLDER

BACKGROUND OF THE INVENTION

1. Field of the Invention

The present invention relates to garbage bag holders and more particularly pertains to a new shoulder-mounted trash bag holder for conveniently carrying a garbage bag while maintaining the same in an open orientation.

2. Description of the Prior Art

The use of garbage bag holders is known in the prior art. More specifically, garbage bag holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,747,653; U.S. Pat. No. 3,697,030; U.S. Pat. No. 5,454,535, U.S. Pat. Des. No. 289,935; U.S. Pat. No. 2,269,257; and U.S. Pat. No. 2,421,740.

In these respects, the shoulder-mounted trash bag holder according to the present invention substantially departs from the conventional concepts and designs of the prior art, and in so doing provides an apparatus primarily developed for the purpose of conveniently carrying a garbage bag while maintaining the same in an open orientation.

SUMMARY OF THE INVENTION

In view of the foregoing disadvantages inherent in the known types of garbage bag holders now present in the prior art, the present invention provides a new shoulder-mounted trash bag holder construction wherein the same can be utilized for conveniently carrying a garbage bag while maintaining the same in an open orientation.

The general purpose of the present invention, which will be described subsequently in greater detail, is to provide a new shoulder-mounted trash bag holder apparatus and method which has many of the advantages of the garbage bag holders mentioned heretofore and many novel features that result in a new shoulder-mounted trash bag holder which is not anticipated, rendered obvious, suggested, or even implied by any of the prior art garbage bag holders, either alone or in any combination thereof.

To attain this, the present invention generally comprises a resilient inner ring defined by a portion of a cylinder with an outer surface and an inner surface. As shown in the Figures, the inner ring has a convex portion with a constant common radius of curvature over about ¾ a circumference of the inner ring. The inner ring further h as a concave portion with a constant common radius of curvature equal to that of the convex portion over about ¼ the circumference of the inner ring. It should be noted that the outer surface of the inner ring has an annular detent protruding therefrom adjacent a lower edge of the inner ring. Also included is a resilient outer ring defined by a portion of a cylinder with an outer surface and an inner surface. As shown in the Figures, the outer ring has a convex portion and a concave portion similar to those of the inner ring. The inner surface of the outer ring has an annular indent protruding therefrom adjacent a lower edge of the outer ring. As such, the outer ring and the inner ring may be snappily attached in order to maintain an upper peripheral edge of garbage bag therebetween. By this structure, an opening of the garbage bag is maintained in an open orientation. Next provided is a handle including an outer strip with a radius of curvature similar to that of the rings. A pair of in-turned tabs are mounted on ends of the outer strip. Also included is a pair of C-shaped clamps each having a central plate coupled to one of the in-turned tabs. Such clamps further include a pair of arms extending from the central plate to define a groove with a depth greater than a combined thickness of the rings. As shown in FIG. 4, each of the arms has an inwardly extending arcuate detent formed thereon. The handle is thus adapted to be snappily mounted to the rings on a side opposite the concave portion. Finally, a shoulder strap assembly is provided including a pair of clamps each having a top face with a pair of lips coupled to side edges of the top face and depending downwardly therefrom. Each of the lips is equipped with a radius of curvature similar to that of the rings. Further, each of the lips has an inwardly extending arcuate detent for engaging the portions of the rings at a central extent thereof. As shown in FIG. 7, the shoulder strap assembly further includes an eyelet mounted to the top face of each of the clamps. A closed loop flexible strap is coupled to the eyelet of each of the clamps for allowing the rings to be supported against a hip of a user in a horizontal orientation. As such, debris or other garbage may be conveniently positioned within the bag during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least on e embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoulder-mounted trash bag holder apparatus and method which has many of the advantages of the garbage bag holders mentioned heretofore and many novel features that result in a new shoulder-mounted trash bag holder which is not anticipated, rendered obvious, suggested, or even implied by any of the prior art garbage bag holders, either alone or in any combination thereof.

It is another object of the present invention to provide a new shoulder-mounted trash bag holder which may be easily and efficiently manufactured and marketed.

It is a further object of the present invention to provide a new shoulder-mounted trash bag holder which is of a durable and reliable construction.

An even further object of the present invention is to provide a new shoulder-mounted trash bag holder which is susceptible of a low cost of manufacture with regard to both materials and labor, and which accordingly is then susceptible of low prices of sale to the consuming public, thereby making such shoulder-mounted trash bag holder economically available to the buying public.

Still yet another object of the present invention is to provide a new shoulder-mounted trash bag holder which provides in the apparatuses and methods of the prior art some of the advantages thereof, while simultaneously overcoming some of the disadvantages normally associated therewith.

Still another object of the present invention is to provide a new shoulder-mounted trash bag holder for conveniently carrying a garbage bag while maintaining the same in an open orientation.

Even still another object of the present invention is to provide a new shoulder-mounted trash bag holder that includes an inner ring and an outer ring. The outer ring is adapted to snappily attach to the inner ring in order to maintain an upper peripheral edge of a garbage bag therebetween. As such, an opening of the garbage bag is maintained in an open orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side cross-sectional view of the present invention taken along line 3—3 shown in FIG. 1.

FIG. 4 is a aide view of the handle of another embodiment of the present invention.

FIG. 5 is a perspective of just the handle of the present invention.

DESCRIPTION OF THE PREFERRED EMBODIMENT

Figure 1:
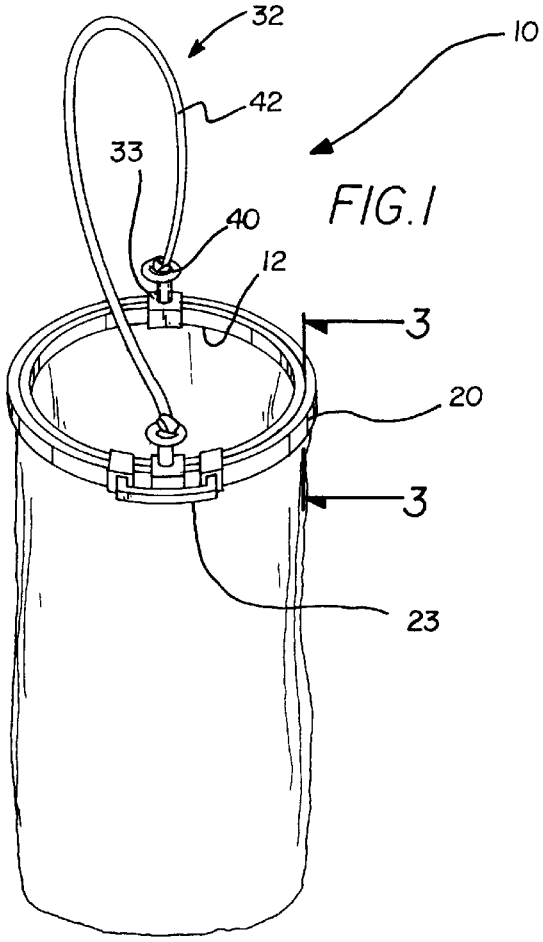
FIG. 1 is a perspective view of a new shoulder-mounted trash bag holder according to the present invention.

With reference now to the drawings, and in particular to FIGS. 1 through 7 thereof, a new shoulder-mounted trash bag holder embodying the principles and concepts of the present invention and generally designated by the reference numeral 10 will be described.

The present invention, designated as numeral 10, includes a resilient inner ring 12 defined by a portion of a cylinder with an outer surface and an inner surface. As shown in the FIG. 6, the inner ring has a convex portion 14 with a constant uniform radius of curvature over about ¾ a circumference of the inner ring. The inner ring further has a concave portion 16 with a constant uniform radius of curvature equal to that of the convex portion over about ¼ the circumference of the inner ring. It should be noted that the outer surface of the inner ring has an annular detent 18 protruding therefrom adjacent a lower edge of the inner ring.

Figure 2:
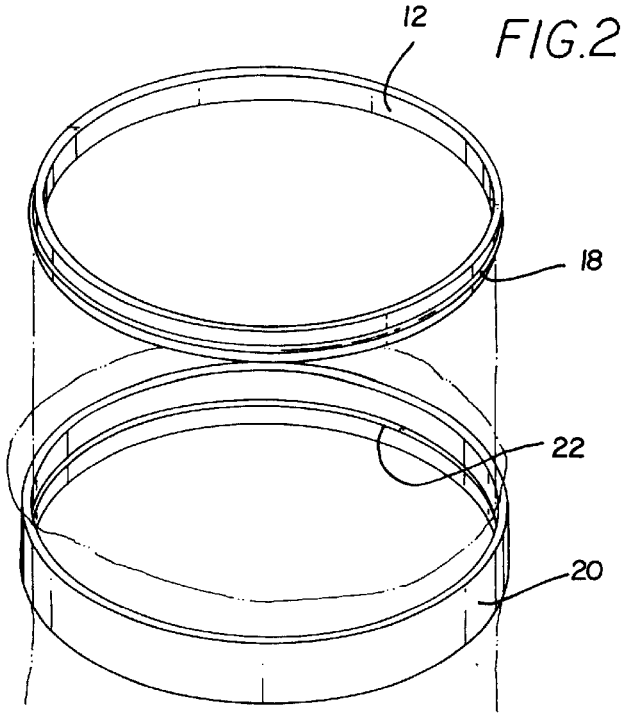
FIG. 2 is an exploded perspective view of the present invention.

Also included is a resilient outer ring 20 defined by a portion of a cylinder with an outer surface and an inner surface. As shown in the Figures, the outer ring has a convex portion and a concave portion similar to those of the inner ring. The inner surface of the outer ring has an annular indent 22 protruding therefrom adjacent a lower edge of the outer ring. As such, the outer ring and the inner ring may be snappily attached in order to maintain an upper peripheral edge of garbage bag therebetween. Note FIG. 3. By this structure, an opening of the garbage bag is maintained in an open orientation. In an alternate embodiment, the rings may be constructed without the convex and the concave portions, as shown in FIGS. 1–2. In both embodiments, the inner ring and the outer ring have diameters of 29¾ and 30 inches, respectively. Further, the rings have a height of 1½ inches and a thickness of ⅛ of an inch.

Figure 6:
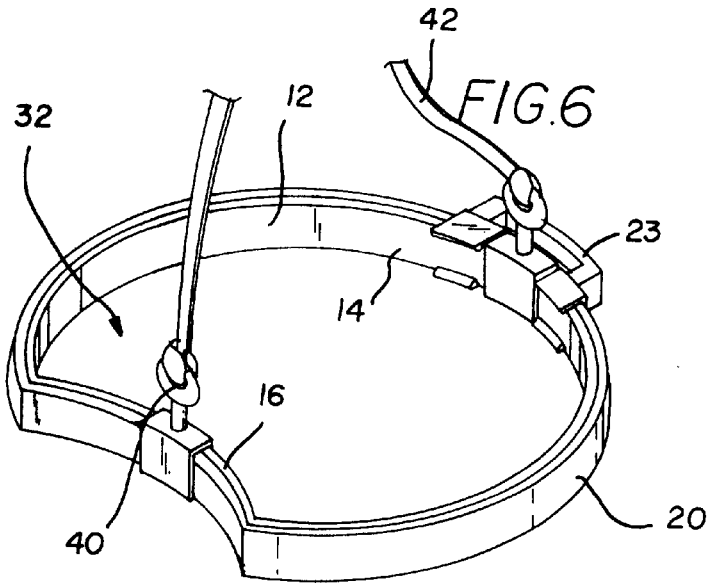
FIG. 6 is a perspective view of the embodiment of the present invention shown in FIGS. 4–5.

Next provided is a handle 23 including an outer strip 24 with a radius of curvature similar to that of the rings. A pair of in-turned tabs 26 are mounted on ends of the outer strip. Also included is a pair of C-shaped clamps 28 each having a central plate 30 coupled to one of the in-turned tabs. Such clamps further include a pair of generally planar arms 31 extending from the central plate in parallel relationship with the in-turned tabs. As shown in FIG. 5, inboard edges of the arms are arcuate and define a groove with a depth greater than a combined thickness of the rings. As shown in FIG. 4, each of the arms has an inwardly extending arcuate detent formed thereon along the inboard edge thereof. In use, the handle is adapted to be snappily mounted to the rings on a side opposite the concave portion. As shown in FIG. 6, the arcuate detents serve to engage the inner surface of the inner ring.

Finally, a shoulder strap assembly 32 is provided including a pair of C-shaped clamps 33 each having a top face 34 with a pair of lips 36 coupled to side edges of the top face and depending downwardly therefrom. Each of the lips is equipped with a radius of curvature similar to that of the rings. Further, each of the lips has an inwardly extending arcuate detent 38 for engaging the portions of the rings at a central extent thereof. Its should be noted that the arcuate detents of the shoulder strap assembly are adapted to engage a lower periphery of the inner and outer rings.

Figure 7:
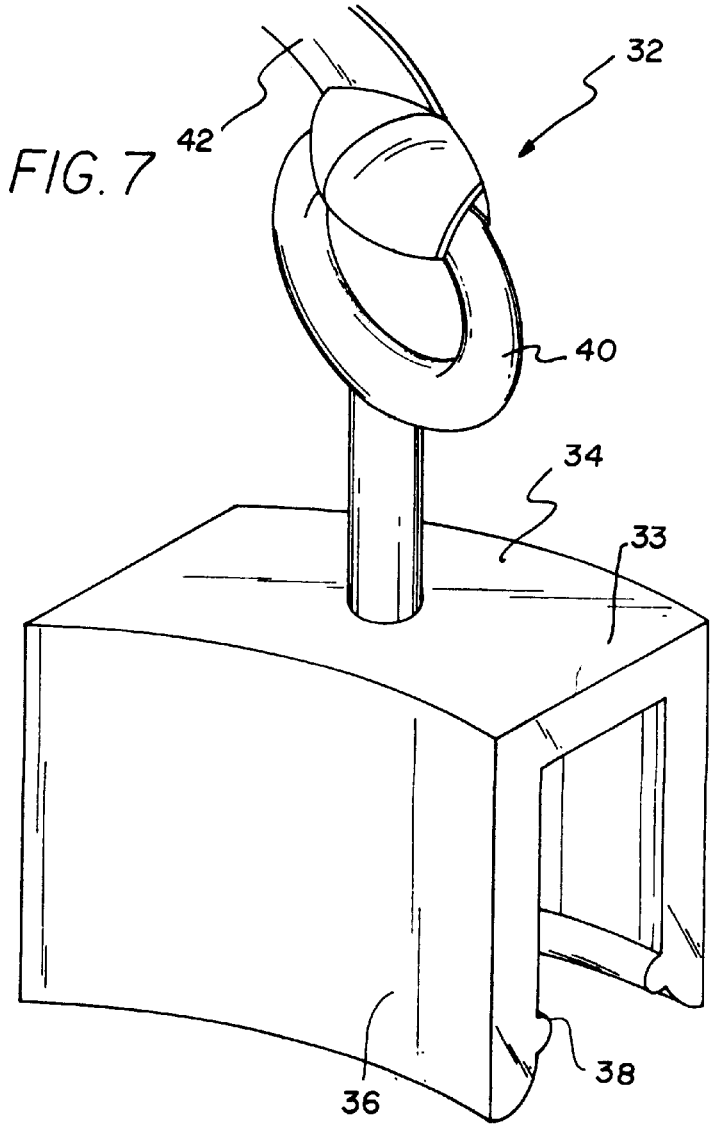
FIG. 7 is detailed a perspective view of the shoulder strap assembly of the present invention.

As shown in FIG. 7, the shoulder strap assembly further includes an eyelet 40 mounted to the top face of each clamp. A closed loop flexible strap 42 is coupled to the eyelets of the clamps of the shoulder strap assembly for allowing the rings to be supported against a hip of a user in a horizontal orientation. As such, debris or other garbage may be conveniently positioned within the bag during use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A bag support system comprising, in combination:

a resilient inner ring defined by a portion of a cylinder with an outer surface and an inner surface, the inner ring having a convex portion with a constant common radius of curvature over about ¾ a circumference of the inner ring and a concave portion with a constant common radius of curvature equal to that of the convex portion over about ¼ the circumference of the inner ring, wherein the outer surface of the inner ring has an annular detent protruding therefrom adjacent a lower edge of the inner ring;

a resilient outer ring defined by a portion of a cylinder with an outer surface and an inner surface, the outer ring having a convex portion with a constant common radius of curvature over about ¾ a circumference of the outer ring and a concave portion with a constant common radius of curvature equal to that of the convex portion over about ¼ the circumference of the outer ring, wherein the inner surface of the outer ring has an annular indent extending thereinto adjacent a lower edge of the outer ring such that the outer ring and the inner ring may be snappily attached in order to maintain an upper peripheral edge of a garbage bag therebetween such that an opening of the garbage bag is maintained in an open orientation;

a handle including an outer strip with a radius of curvature similar to that of the rings, a pair of in-turned tabs mounted on ends of the outer strip, and a pair of C-shaped clamps each having a central plate coupled to one of the in-turned tabs and a pair of arms extending from the central plate to define a groove with a depth greater than a combined thickness of the rings, wherein each of the arms has an inwardly extending arcuate detent formed therein such that the handle is adapted to be snappily mounted to the rings; and a shoulder strap assembly including a pair of clamps each having a top face with a pair of lips coupled to side edges of the top face and depending downwardly therefrom each with a radius of curvature similar to that of the rings, each of the lips having an inwardly extending arcuate detent for engaging the portions of the rings at a central extent thereof, the shoulder strap assembly further including an eyelet mounted to the top face of each clamp and a closed loop flexible strap coupled to the eyelet of one of the clamps for allowing the rings to be supported against a hip of a user in a horizontal orientation.

2. A bag support system comprising:

an inner ring having an outward perimeter surface; and an outer ring having an inward perimeter surface adapted to snap couple to the outward perimeter surface of the inner ring such that the outer ring encompasses the inner ring for maintaining an upper peripheral edge of a garbage bag between the outward perimeter surface and the inward perimeter surface such that an opening of the garbage bag is maintained in an open orientation;

wherein each of the rings has first and second arcuate perimeter portions, the first arcuate perimeter portion comprising an outwardly convex portion adapted for situating against a portion of a torso of a user and the second arcuate perimeter portion comprising an outwardly concave portion for maintaining the opening of the bag in an open orientation.

3. A bag support system as set forth in claim 2 wherein the outwardly convex portion of each of the rings is relatively longer than the outwardly concave portion of each of the rings.

4. A bag support system as set forth in claim 2 wherein an annular detent and an annular indent permit snap coupling and uncoupling of the rings.

5. A bag support system as set forth in claim 2 and further including a handle with at least one clamp removably attached to the rings, the handle being slidable along the rings for selectively positioning the handle at substantially any position along the first and second arcuate perimeter portions.

6. A bag support system as set forth in claim 2 wherein the rings have a shoulder strap assembly attached thereto, the shoulder strap assembly including a pair of clamps being slidable along the rings for selectively positioning the clamps at substantially any positions along the first and second arcuate perimeter portions.

7. A bag support system as set forth in claim 6 wherein the clamps of the shoulder strap assembly are adapted to embrace the inner and outer rings when the rings are snap coupled together for facilitating securement of the rings together.

8. A bag support system as set forth in claim 5 wherein the clamp of the handle is adapted to embrace the inner and outer rings when the rings are snap coupled together for facilitating securement of the rings together.

9. A bag support system as set forth in claim 8 wherein the handle includes two spaced clamps removably embracing spaced portions of the inner and outer rings.

10. A bag support system as set forth in claim 2 wherein the outwardly convex portions of the rings each have a center of curvature inside the rings, and the outwardly concave portions of the rings each have a center of curvature outside the rings.

11. A bag support system comprising:

a resilient inner ring defined by a portion of a cylinder with an outer surface and an inner surface, the inner ring having a convex portion with a constant common radius of curvature and a concave portion with a constant common radius of curvature, wherein the outer surface of the inner ring has an annular detent protruding therefrom;

a resilient outer ring defined by a portion of a cylinder with an outer surface and an inner surface, the outer ring having a convex portion with a constant common radius of curvature and a concave portion with a constant common radius of curvature, wherein the inner surface of the outer ring has an annular indent extending thereinto such that the outer ring and the inner ring may be snap coupled together in order to maintain an upper peripheral edge of a garbage bag between the inner and outer rings such that an opening of the garbage bag is maintained in an open orientation;

a handle including an outer strip, a pair of tabs mounted on ends of the outer strip, and a pair of C-shaped clamps each having a central plate coupled to one of the tabs and a pair of arms extending from the central plate to define a groove, wherein each of the arms has an inwardly extending arcuate detent formed therein such that the handle is adapted to be snap mounted to the rings; and a shoulder strap assembly including a pair of clamps each having a top face with a pair of lips coupled to the top face and depending downwardly therefrom, each of the lips having an inwardly extending arcuate detent for engaging the portions of the rings, the shoulder strap assembly further including an eyelet mounted to the top face of each clamp and a flexible strap having opposite end portions, each opposite end portion being coupled to the eyelet of one of the clamps.

* * * * *